US012384503B2

(12) United States Patent
Crawford

(10) Patent No.: US 12,384,503 B2
(45) Date of Patent: Aug. 12, 2025

(54) ICE BUILDUP PREVENTION FOR TROLLING MOTOR AND SONAR DEVICE ASSEMBLIES

(71) Applicant: Navico, Inc., Tulsa, OK (US)

(72) Inventor: Christopher D. Crawford, Bixby, OK (US)

(73) Assignee: NAVICO, INC., Tulsa, OK (US)

( * ) Notice: Subject to any disclaimer, the term of this patent is extended or adjusted under 35 U.S.C. 154(b) by 463 days.

(21) Appl. No.: 18/155,947

(22) Filed: Jan. 18, 2023

(65) Prior Publication Data

US 2024/0239462 A1 Jul. 18, 2024

(51) Int. Cl.

| | |
|---|---|
| ***B63H 20/12*** | (2006.01) |
| ***B63B 79/10*** | (2020.01) |
| ***B63H 20/00*** | (2006.01) |
| ***B63H 20/10*** | (2006.01) |

(52) U.S. Cl.

CPC ..... *B63H 20/12* (2013.01); *B63B 79/10* (2020.01); *B63H 20/007* (2013.01); *B63H 20/10* (2013.01)

(58) Field of Classification Search

CPC ..... B63H 20/12; B63H 20/007; B63H 20/10; B63B 79/10

See application file for complete search history.

(56) References Cited

U.S. PATENT DOCUMENTS

2023/0062830 A1* 3/2023 Raffills ..... B63H 20/106

FOREIGN PATENT DOCUMENTS

WO WO-2018002414 A1 * 1/2018 ..... B63H 5/125

* cited by examiner

*Primary Examiner* — Stephen P Avila
(74) *Attorney, Agent, or Firm* — Nelson Mullins Riley & Scarborough LLP

(57) ABSTRACT

Trolling motor assemblies, systems, and methods configured for prevention of ice buildup are provided herein. A trolling motor assembly has a trolling motor with a shaft, a head housing, and a trolling motor housing. One or more actuators are configured to adjust at least one of a pointing direction or a depth of the trolling motor housing relative to the watercraft. The trolling motor has a processor and a memory including code configured to cause the processor to activate the one or more actuators to cause automatic execution of a movement routine. The movement routine at least temporarily adjusts at least one of the depth or the pointing direction of the trolling motor housing to reduce a likelihood of ice buildup. Various assemblies, systems, and methods are also applicable to steerable and/or movable sonar transducer assemblies.

20 Claims, 7 Drawing Sheets

ICE BUILDUP PREVENTION FOR TROLLING MOTOR AND SONAR DEVICE ASSEMBLIES

FIELD OF THE INVENTION

Embodiments of the present invention relate generally to marine device assemblies, such as trolling motor assemblies and sonar transducer assemblies.

BACKGROUND OF THE INVENTION

Marine device assemblies, such as trolling motor assemblies and sonar transducer assemblies having one or more sonar transducer elements, are often used during fishing or other marine activities. The trolling motor assembly attaches to the watercraft and propels the watercraft along a body of water. While trolling motor assemblies may be utilized as the main propulsion system of watercraft, trolling motor assemblies are often utilized to provide secondary propulsion or precision maneuvering that can be ideal for fishing activities. Typically, trolling motor assemblies include a small gas or electric trolling motor for providing thrust and a steering mechanism for changing the direction of the generated thrust. Trolling motor assemblies may also include a trim mechanism for changing the depth of the trolling motor, either electrically or manually. Sonar transducer assemblies include one or more sonar transducer elements that emit sonar signals into the underwater environment when submerged therein. The sonar transducer assemblies may be attached to a pole or other attachment device and a steering mechanism can be used to adjust the rotation direction of the sonar transducer elements. In some cases, a trim mechanism can be used to change the relative depth of the sonar transducer elements with respect to the watercraft.

Trolling motor assemblies and sonar transducer assemblies are often used in colder environments where a body of water reaches temperature levels that are below the freezing temperature of water. Where this is the case, a risk arises that ice will build up on the trolling motor assembly and/or the sonar transducer assembly, such as within various components of either assembly (e.g., a drive belt, an actuator (e.g., steering mechanism, trim mechanism, etc.)). Ice buildup on these components may result in poor performance and/or required maintenance. For example, ice buildup may tend to restrict movement of components within a trolling motor assembly or sonar transducer assembly, ice buildup may limit movement of these components so that the actual movement of these components is less than the intended movement for these components, and/or the ice buildup may cause unwanted wear and tear on the trolling motor assembly, the sonar transducer assembly, and the components therein. Where ice buildup occurs, a user must manually remove ice from the trolling motor assembly, the sonar transducer assembly, or the components therein. Such manual removal may involve a user scraping off ice or melting ice, and this is often an unpleasant and time-consuming experience for the user. Melting ice may also pose a safety hazard to the trolling motor assembly, the sonar transducer assembly, and to the user, and improper handling while melting ice may also lead to damage in trolling motor assembly components, or the sonar transducer assembly components.

BRIEF SUMMARY OF THE INVENTION

Various embodiments are described herein that provide improvements to trolling motor assemblies and/or sonar transducer assemblies to reduce the likelihood of ice buildup. The trolling motor assemblies and/or the sonar transducer assemblies include one or more actuators that may be used to adjust at least one of a pointing direction or a depth of the trolling motor housing relative to the watercraft. For example, the one or more actuators may be used to rotate a shaft associated with the trolling motor assembly and/or the sonar transducer assembly about its axis, to shift the trolling motor housing and/or the sonar transducer elements up and down, and/or to adjust the depth and/or the pointing direction of the trolling motor housing and/or the sonar transducer elements in other ways. In this regard, the one or more actuators may be used during execution of a movement routine to reduce the likelihood of ice buildup. In some embodiments, the movement routines may involve slight movements of the trolling motor housing. In some embodiments, the movement routines may involve movements that are imperceptible to the user as the user is operating a watercraft. However, larger movements may be used that are perceptible to the user. By causing these movements, ice that has built up on the trolling motor assembly and/or the sonar transducer assembly may be removed. This may include limiting ice buildup on various components of the trolling motor assembly and/or the sonar transducer assembly, such as the one or more actuators. Movement routines may be executed automatically, and this is beneficial to limit the involvement of the user so that the user may be permitted to perform other tasks. In some embodiments, the current temperature, such as of the air and/or water, may be used to determine when to initiate or cease execution of a movement routine and/or how to operate during the movement routine. In some embodiments, the user may initiate or cease execution of a movement routine and/or configure how to operate during the movement routine.

By reducing the likelihood of ice buildup, components within a trolling motor assembly and/or the sonar transducer assembly may be permitted to move more freely. Further, actual movement of components within a trolling motor assembly and/or the sonar transducer assembly may more closely match the intended movement of components, permitting the user to better control the operation of the watercraft, the trolling motor assembly, and/or the sonar transducer assembly. Additionally, reducing the likelihood of ice buildup may result in the trolling motor assembly, the sonar transducer assembly, and the components therein being subject to less wear and tear, so the trolling motor assembly and/or the sonar transducer assembly may function properly for a longer period of time with less need for maintenance. Additionally, the movement routines described herein may allow users to remove ice without the need for manual intervention by the user, so the user may avoid having to manually scrape or melt ice off of the trolling motor assembly components and/or the sonar transducer assembly components.

In an example embodiment, a trolling motor assembly is provided that is configured for prevention of ice buildup. The trolling motor assembly includes a trolling motor comprising a shaft defining a first end and a second end. The trolling motor further comprises a head housing at the first end and a trolling motor housing at the second end, and the trolling motor is configured to be attached on a watercraft so that the trolling motor housing lies in a body of water when the trolling motor is attached to the watercraft and in a deployed state. The trolling motor assembly also includes one or more actuators that are configured to adjust at least one of a pointing direction of the trolling motor housing or a depth of the trolling motor housing relative to the watercraft while the trolling motor is attached to the watercraft. The trolling motor assembly also includes a processor and memory. The memory includes computer program code that is configured to, when executed, cause the processor to activate the actuator(s) to cause a movement routine to be executed. The movement routine is performed automatically, and the movement routine reduces a likelihood of ice buildup. The movement routine at least temporarily adjusts at least one of the depth or the pointing direction of the trolling motor housing relative to the watercraft.

In some embodiments, the movement routine may involve continuous movement of the trolling motor housing. In some embodiments, the movement routine may involve periodic movement of the trolling motor housing.

In some embodiments, the movement routine may be executed when the trolling motor is not being actively used to generate thrust. In some embodiments, the actuator(s) may include a steering system, and the movement routine may cause a rotational orientation change of the shaft of the trolling motor using the steering system. In some embodiments, the actuator(s) may include a trim system and a steering system, and the movement routine may cause a vertical displacement change and a rotational orientation change of the shaft of the trolling motor using the trim system and the steering system.

In some embodiments, the trolling motor assembly may also include a temperature sensor that is configured to determine a temperature value. Further, the computer program code may be configured to, when executed, cause the processor to receive the temperature value and adjust the movement routine based on the temperature value. The movement routine may be adjusted by increasing at least one of a frequency of movement, a duration of movement, or a magnitude of movement when the temperature value is below a threshold temperature value. Additionally, in some embodiments, the temperature sensor may be a thermistor.

In some embodiments, the trolling motor assembly may also include a temperature sensor that is configured to determine a temperature value. Further, the computer program code may be configured to, when executed, cause the processor to receive the temperature value and either, based on the temperature value, initiate the movement routine or refrain from activating the actuator(s) and from causing the movement routine to be executed.

In some embodiments, the computer program code may be configured to, when executed, cause the processor to receive an indication of the depth of the trolling motor housing and adjust the movement routine based on the indication of the depth of the trolling motor housing. The movement routine may be adjusted by reducing at least one of a frequency of movement, a duration of movement, or a magnitude of movement when the depth of the trolling motor housing is below a threshold depth value.

In some embodiments, the actuator(s) may include a trim system, and the movement routine may cause the depth of the trolling motor housing to be changed using the trim system. Additionally, in some embodiments, the movement routine may reduce the likelihood of ice buildup at the trim system.

In another example embodiment, a system configured for prevention of ice buildup is provided. The system includes a trolling motor comprising a shaft defining a first end and a second end. The trolling motor also includes a head housing at the first end and a trolling motor housing at the second end. The trolling motor is configured to be attached on a watercraft so that the trolling motor housing lies in a body of water when the trolling motor is attached to the watercraft and in a deployed state. The system also includes one or more actuators that are configured to adjust at least one of a pointing direction of the trolling motor housing or a depth of the trolling motor housing relative to the watercraft while the trolling motor is attached to the watercraft. The system includes a processor and memory as well. The memory includes computer program code configured to, when executed, cause the processor to activate the actuator(s) to cause a movement routine to be executed. The movement routine is performed automatically, and the movement routine reduces a likelihood of ice buildup. The movement routine at least temporarily adjusts at least one of the depth or the pointing direction of the trolling motor housing relative to the watercraft.

In some embodiments, the system may also include a temperature sensor that is configured to determine a temperature value. Furthermore, the computer program code may be configured to, when executed, cause the processor to receive the temperature value and adjust the movement routine based on the temperature value. The movement routine may be adjusted by increasing at least one of a frequency of movement, a duration of movement, or a magnitude of movement when the temperature value is below a threshold temperature value. Additionally, in some embodiments, the computer program code may be configured to, when executed, cause the processor to receive an indication of the depth of the trolling motor housing and adjust the movement routine based on the indication of the depth of the trolling motor housing. The movement routine may be adjusted by reducing at least one of a frequency of movement, a duration of movement, or a magnitude of movement when the depth of the trolling motor housing is below a threshold depth value.

In another example embodiment, a method for prevention of ice buildup is provided. The method comprises providing a trolling motor comprising a shaft defining a first end and a second end. The trolling motor also includes a head housing at the first end and a trolling motor housing at the second end, and the trolling motor is configured to be attached on a watercraft so that the trolling motor housing lies in a body of water when the trolling motor is attached to the watercraft and in a deployed state. The method also includes providing one or more actuators and activating the actuator(s) to cause a movement routine to be executed. The movement routine is performed automatically, and the movement routine reduces the likelihood of ice buildup. The movement routine at least temporarily adjusts at least one of a position or an orientation of the trolling motor housing relative to the watercraft while the trolling motor is attached to the watercraft.

In some embodiments, the actuator(s) may be activated to cause a movement routine to be executed when the temperature value is less than a threshold value. Additionally, in some embodiments, the movement routine may be configured so as to only be executed when the trolling motor housing is not being actively used to generate thrust.

In some embodiments, the method may also include adjusting the movement routine based on an indication of the depth of the trolling motor housing, and the actuator(s) may be activated to cause a movement routine to be executed when the indication of the depth indicates that the depth exceeds a threshold value. Furthermore, in some embodiments, the movement routine may be adjusted by changing a frequency of movement, a magnitude of movement, or a duration of movement.

In another example embodiment, an assembly configured for prevention of ice buildup is provided. The assembly includes a first subassembly. The first subassembly includes at least one of a trolling motor or a sonar transducer element, and the first subassembly includes a shaft defining a first end and a second end. At least one of the sonar transducer element or a trolling motor housing are attached at the second end of the shaft. The first subassembly is configured to be attached on a watercraft so that the second end of the shaft lies in a body of water when the first subassembly is attached to the watercraft and in a deployed state. The assembly also includes one or more actuators that are configured to adjust at least one of a pointing direction of the trolling motor housing relative to the watercraft, a pointing direction of the sonar transducer element relative to the watercraft, a depth of the trolling motor housing relative to the watercraft, or a depth of the sonar transducer element relative to the watercraft while the first subassembly is attached to the watercraft. The assembly also includes a processor and a memory including computer program code configured to, when executed, cause the processor to activate the actuator(s) to cause a movement routine to be executed. The movement routine is performed automatically, and the movement routine reduces a likelihood of ice buildup at the first subassembly. Also, the movement routine at least temporarily adjusts at least one of the depth or the pointing direction of the trolling motor housing or the sonar transducer element relative to the watercraft.

In some embodiments, the first subassembly may include the sonar transducer element, and the first subassembly may not include a trolling motor. In some embodiments, the actuator(s) may include a steering system, and the movement routine may cause a rotational orientation change of the shaft using the steering system. In some embodiments, the actuator(s) may include a trim system and a steering system, and the movement routine may cause a vertical displacement change and a rotational orientation change of the shaft using the trim system and the steering system.

In some embodiments, the movement routine may involve continuous movement of the trolling motor housing or the sonar transducer element. In some embodiments, the movement routine may involve periodic movement of the trolling motor housing or the sonar transducer element.

In some embodiments, the assembly may also include a temperature sensor that is configured to determine a temperature value. Additionally, the computer program code may be configured to, when executed, cause the processor to receive the temperature value and adjust the movement routine based on the temperature value. The movement routine may be adjusted by increasing at least one of a frequency of movement, a duration of movement, or a magnitude of movement when the temperature value is below a threshold temperature value.

In some embodiments, the assembly may also include a temperature sensor that is configured to determine a temperature value. Furthermore, the computer program code is configured to, when executed, cause the processor to receive the temperature value and either, based on the temperature value, initiate the movement routine or refrain from activating the actuator(s) and from causing the movement routine to be executed.

In some embodiments, the computer program code may be configured to, when executed, cause the processor to receive an indication of a depth of the trolling motor housing or the sonar transducer element and to adjust the movement routine based on the indication of the depth of the trolling motor housing or the sonar transducer element. The movement routine may be adjusted by reducing at least one of a frequency of movement, a duration of movement, or a magnitude of movement when the depth of the trolling motor housing or the sonar transducer element is below a threshold depth value.

In some embodiments, the actuator(s) may include a trim system, and the movement routine may cause a depth of the trolling motor housing or the sonar transducer element to be changed using the trim system. Additionally, in some embodiments, the movement routine may reduce the likelihood of ice buildup at the trim system.

BRIEF DESCRIPTION OF THE DRAWINGS

Figure 1:
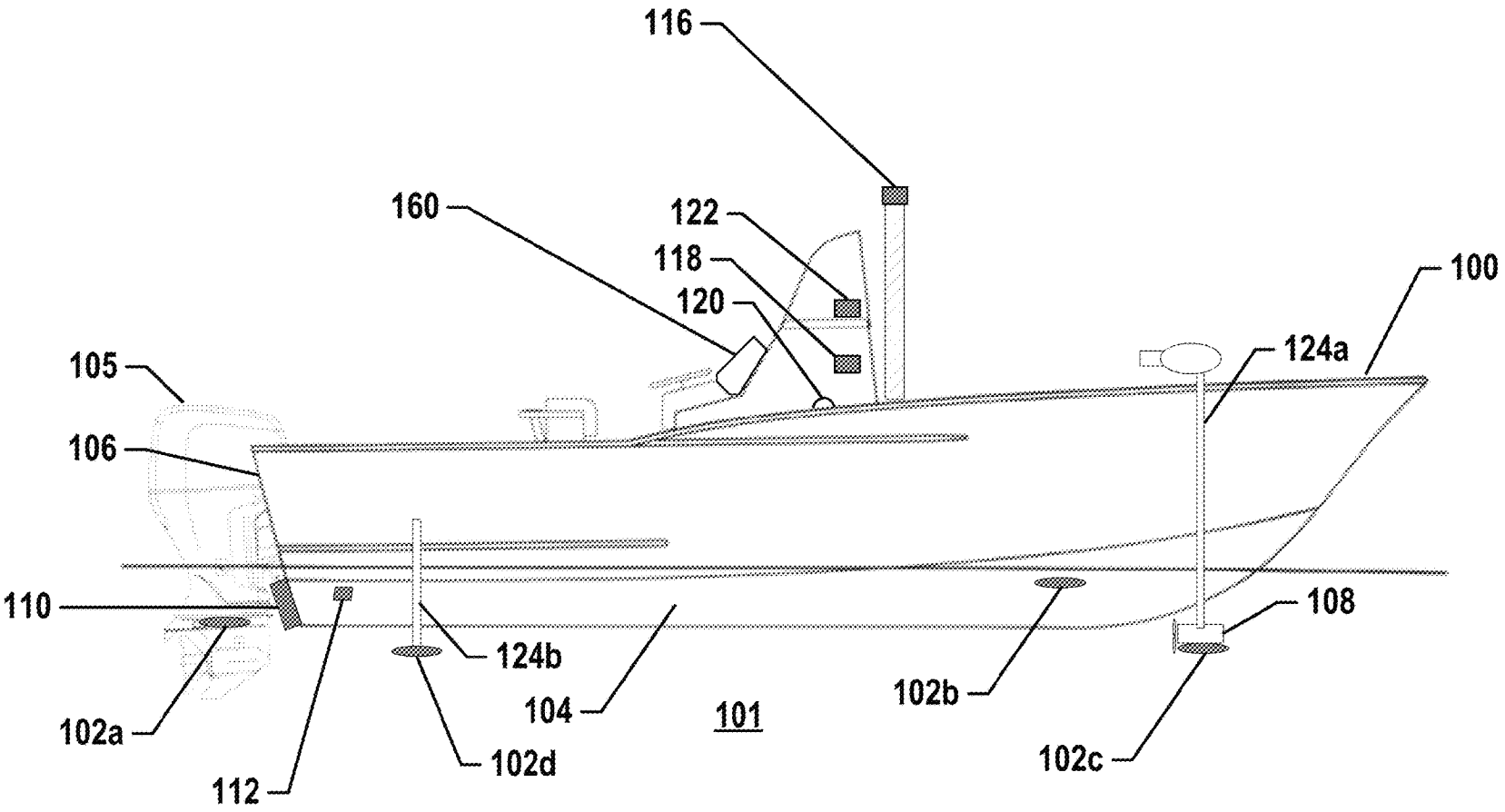
Figure 2:
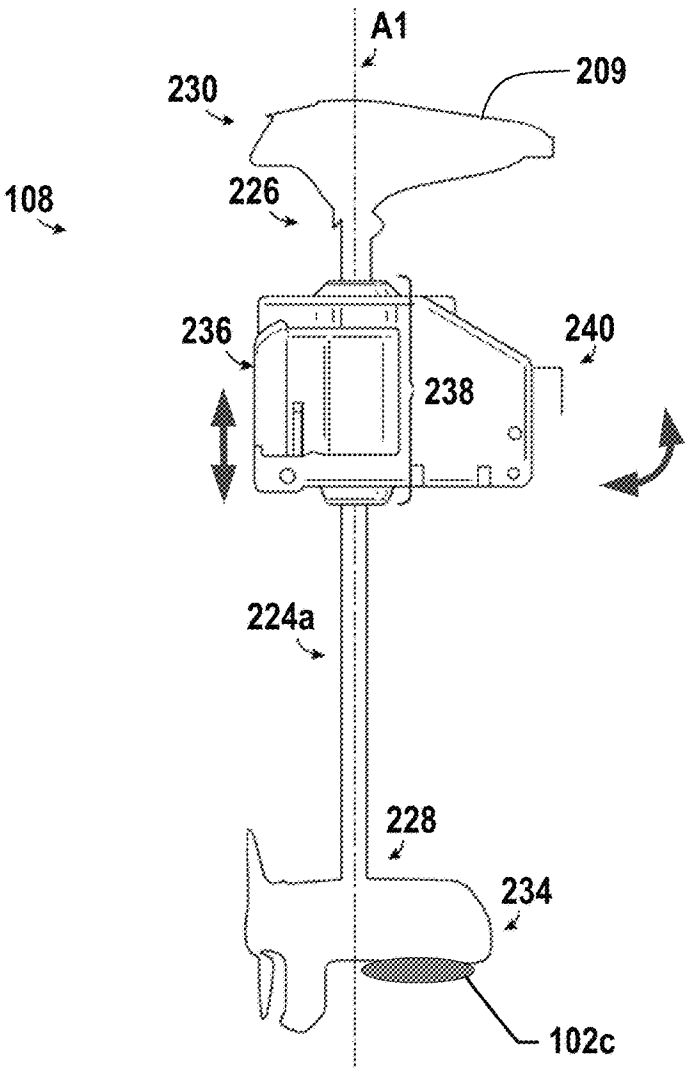
Figure 3:
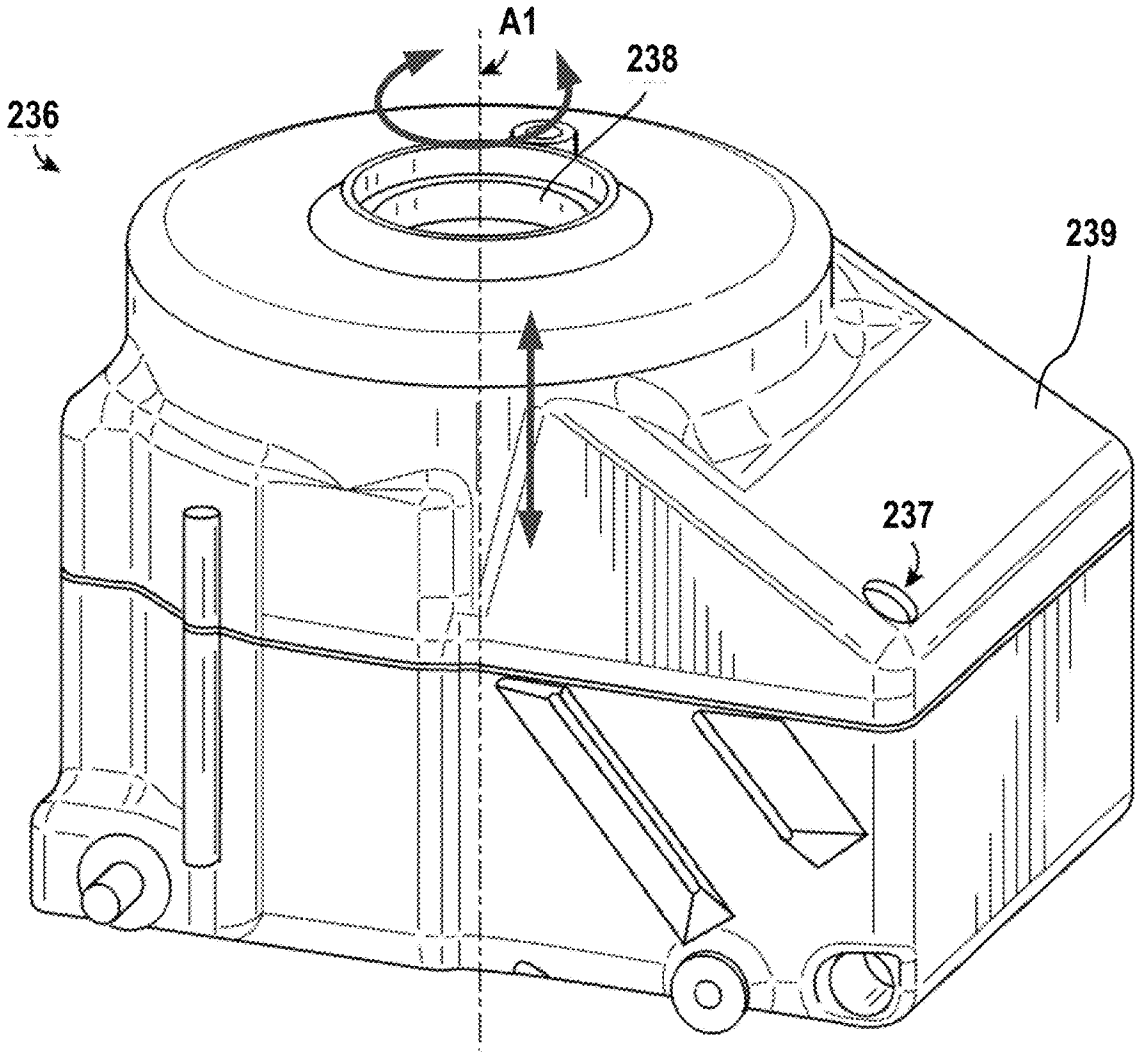
Figure 4:
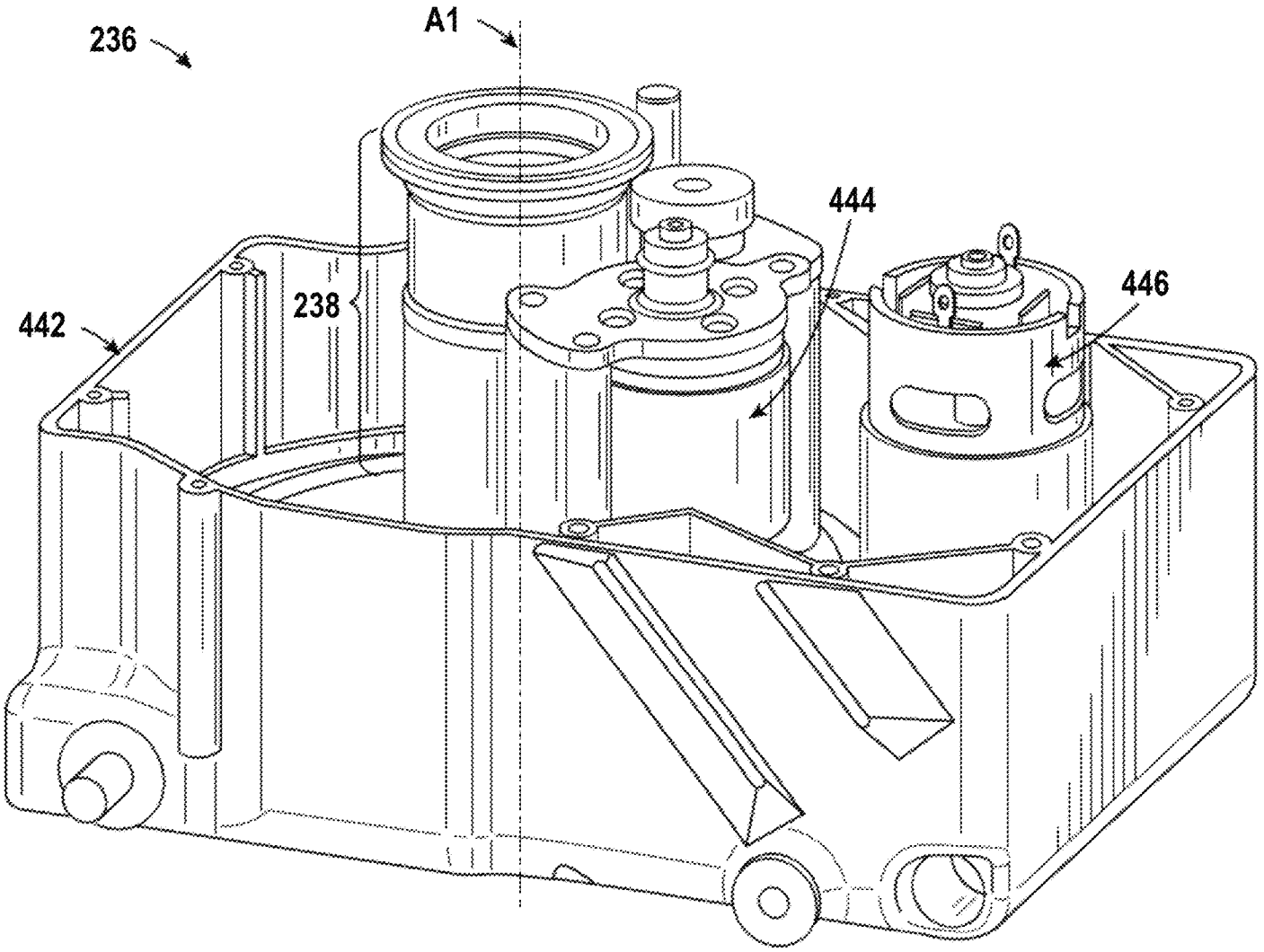
Figure 5:
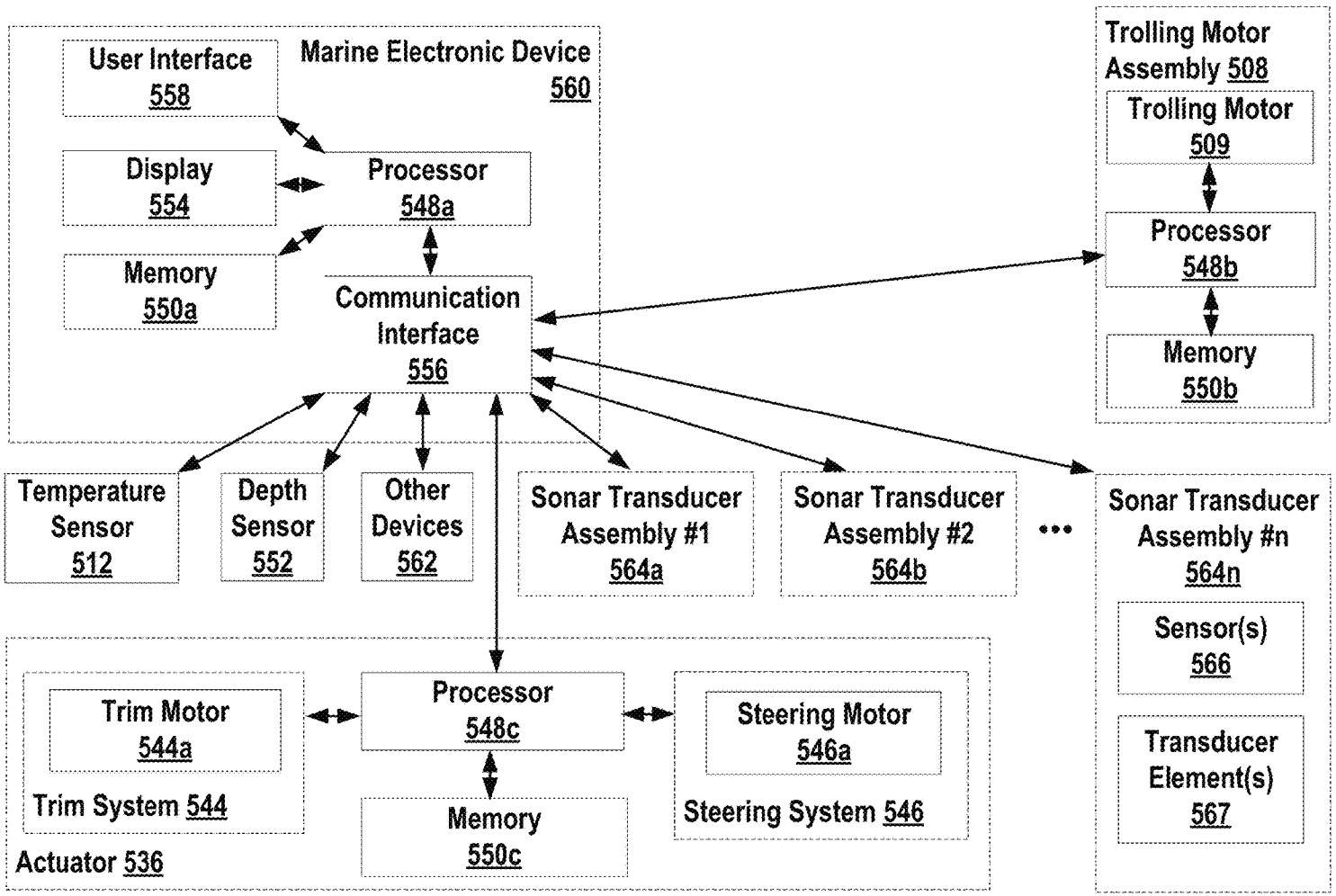
Figure 6A:
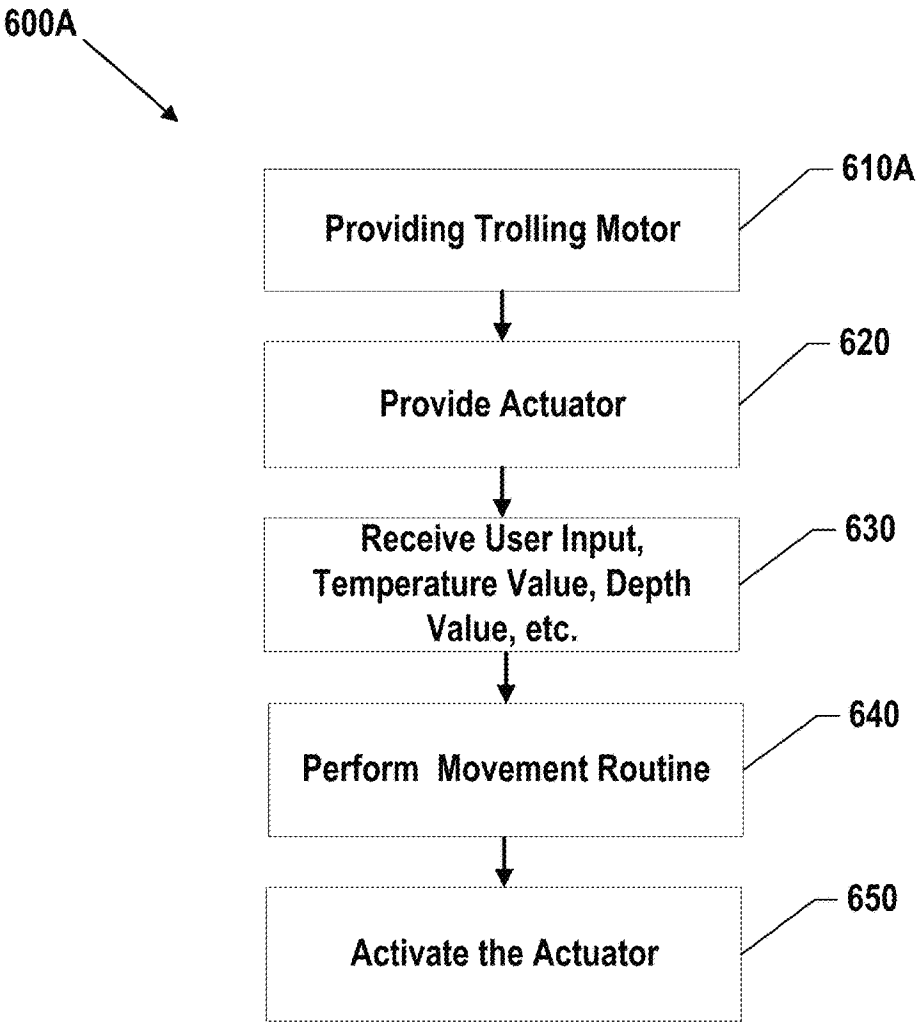
Figure 6B:
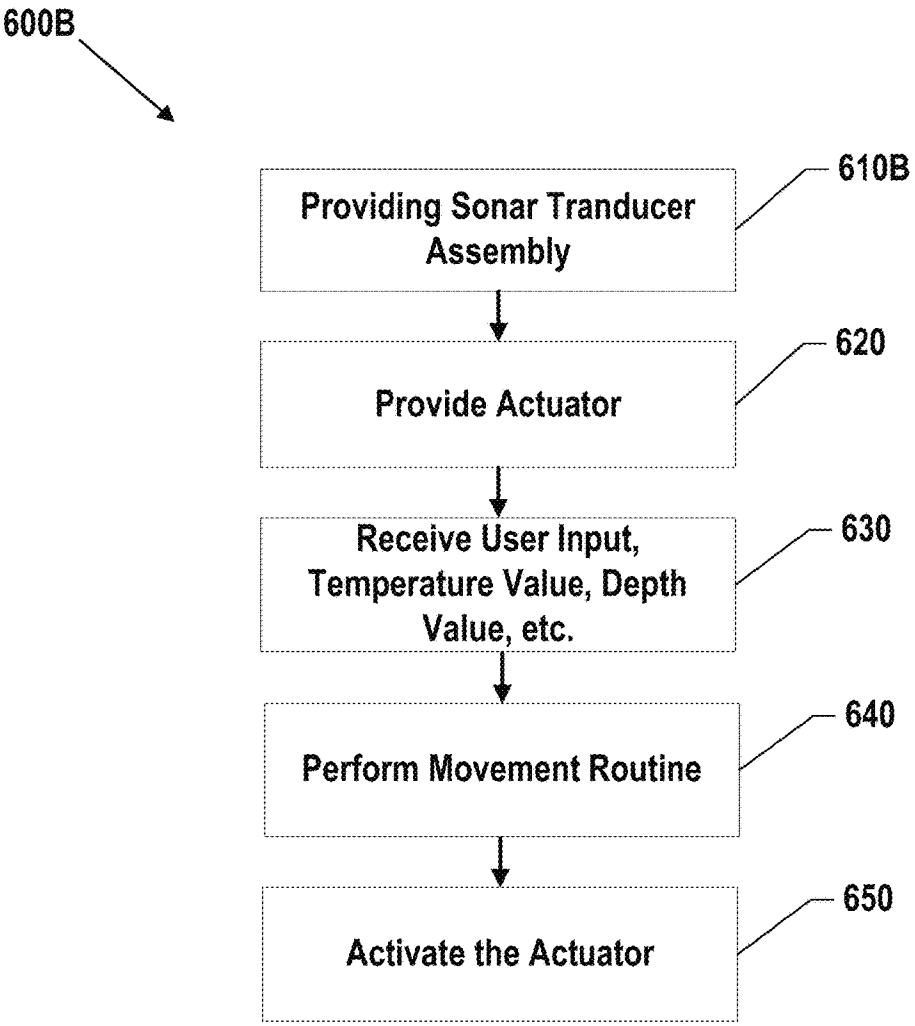

Having thus described the invention in general terms, reference will now be made to the accompanying drawings, which are not necessarily drawn to scale, and wherein:

FIG. 1 is a schematic view illustrating an example watercraft, in accordance with some embodiments discussed herein;

FIG. 2 is a schematic side view illustrating an example trolling motor assembly with a trolling motor and an actuator, in accordance with some embodiments discussed herein;

FIG. 3 is a perspective view illustrating an example actuator, in accordance with some embodiments discussed herein;

FIG. 4 is a perspective view illustrating an example actuator with a top cover of the actuator removed, in accordance with some embodiments discussed herein;

FIG. 5 is a block diagram illustrating example electrical components that may be used in an example system, in accordance with some embodiments discussed herein; and FIGS. 6A and 6B are flowcharts illustrating example methods for prevention of ice buildup, in accordance with some embodiments discussed herein.

DETAILED DESCRIPTION

Example embodiments of the present invention now will be described more fully hereinafter with reference to the accompanying drawings, in which some, but not all embodiments of the invention are shown. Indeed, the invention may be embodied in many different forms and should not be construed as limited to the example embodiments set forth herein; rather, these embodiments are provided so that this disclosure will satisfy applicable legal requirements. Like reference numerals generally refer to like elements throughout. For example, reference numerals 236 and 536 are each intended to refer to an actuator. Additionally, any connections or attachments may be direct or indirect connections or attachments unless specifically noted otherwise.

FIG. 1 illustrates an example watercraft 100 including various marine devices, in accordance with some embodiments discussed herein. As depicted in FIG. 1, the watercraft 100 (e.g., a vessel) is configured to traverse a marine environment, e.g. body of water 101, and may use one or more sonar transducer assemblies 102*a*, 102*b*, 102*c*, and 102*d* disposed on and/or proximate to the watercraft 100. Notably, example watercraft contemplated herein may be a surface watercraft, submersible watercraft, or any other implementation known to those skilled in the art. The transducer assemblies 102*a*, 102*b*, 102*c*, and 102*d* may each include one or more transducer elements (such as in the form of the example assemblies described herein) configured to transmit sound waves (e.g., sonar signals) into a body of water 101, receive sonar returns from the body of water 101, and convert the sonar returns into sonar return data. Various types of sonar transducers may be provided—for example, one or more of a linear downscan sonar transducer, a conical downscan sonar transducer, a sonar transducer array, a sidescan sonar transducer, a frequency-steered transducer array, or other transducer array may be used.

Depending on the configuration, the watercraft 100 may include a primary motor 105, which may be a main propulsion motor such as an outboard or inboard motor. Additionally, the watercraft 100 may include a trolling motor assembly 108 having a trolling motor 209 (see FIG. 2) configured to propel the watercraft 100. Motors may also take the form of a hybrid propulsion system (using electric and endothermic systems) and an electric propulsion system. The one or more transducer assemblies (e.g., 102*a*, 102*b*, 102*c*, and/or 102*d*) may be mounted in various positions and to various portions of the watercraft 100 and/or equipment associated with the watercraft 100. For example, the transducer assembly may be mounted to the transom 106 of the watercraft 100, such as depicted by transducer assembly 102*a*. The transducer assembly may be mounted to the bottom or side of the hull 104 of the watercraft 100, such as depicted by transducer assembly 102*b*. The transducer assembly may be mounted to the trolling motor 209 (see FIG. 2) of the trolling motor assembly 108 having a shaft 124*a*, such as depicted by transducer assembly 102*c*. The transducer assembly may be mounted to its own shaft 124*b*, such as depicted by transducer assembly 102*d*. The shaft 124*b* is provided proximate to the transom 106, but the shaft 124*b* may be provided at other locations on the watercraft 100 such as at the hull 104 or attached to the trolling motor 209.

The watercraft 100 may also include one or more marine electronic devices 160, such as may be utilized by a user to interact with, view, or otherwise control various aspects of the various sonar systems described herein. In the illustrated embodiment, the marine electronic device 160 is positioned proximate the helm (e.g., steering wheel) of the watercraft 100—although other positions on the watercraft 100 are contemplated. Likewise, additionally or alternatively, a remote device (such as a user's mobile device) may include functionality of a marine electronic device.

The watercraft 100 may also comprise other components within the one or more marine electronic devices 160 or at the helm. In FIG. 1, the watercraft 100 comprises a radar 116, which is mounted at an elevated position (although other positions relative to the watercraft are also contemplated). The watercraft 100 also comprises an AIS transceiver 118, a direction sensor 120, and a camera 122, and these components are each positioned at or near the helm (although other positions relative to the watercraft are also contemplated). Additionally, the watercraft 100 comprises a rudder 110 at the stern of the watercraft 100, and the rudder 110 may be positioned on the watercraft 100 so that the rudder 110 rests in the body of water 101. In other embodiments, these components may be integrated into the one or more marine electronic devices 160 or other devices. Another example device on the watercraft 100 may be a temperature sensor 112 that may be positioned so that it rests within or outside of the body of water 101. Other example devices include a wind sensor, a noise sensor, one or more speakers, and various vessel devices/features (e.g., doors, bilge pump, fuel tank, etc.), among other things. Additionally, one or more sensors may be associated with marine devices; for example, a sensor may be provided to detect the position of the primary motor 105, the trolling motor 209 (see FIG. 2) of the trolling motor assembly 108, or the rudder 110. In some embodiments, a display may be provided at the marine electronic device 160, but the display may be provided outside of any marine electronic device 160 in other embodiments.

Depending on the design, motor may be gas-powered or electric (or hybrid). Moreover, for trolling motors of a trolling motor assembly 108, steering may be accomplished, via foot control, or even through use of a remote control. Additionally, in some cases, an autopilot may operate the trolling motor 209 (see FIG. 2) autonomously. The trolling motor 209 (see FIG. 2) is configured to propel the watercraft 100 to travel along the body of water 101.

An actuator may be provided to assist in inducing movement of a trolling motor assembly and/or a sonar transducer assembly relative to a watercraft, and the actuator may be used to execute movement routines to assist in preventing ice buildup. In some embodiments, the actuator may be provided in a trolling motor assembly, but the actuator may be provided in a sonar transducer assembly in other embodiments. FIG. 2 is a schematic side view illustrating an example trolling motor assembly 108 with a trolling motor 209 and an actuator 236. As illustrated in FIG. 2, the trolling motor 209 has a shaft 224*a* defining a first end 226 and a second end 228. The shaft 224*a* also defines a shaft axis (A1), with the shaft 224*a* extending lengthwise along the shaft axis (A1). The trolling motor 209 also includes a head housing 230 and a trolling motor housing 234. The head housing 230 of the trolling motor 209 is provided at the first end 226 of the shaft 224*a*, and the trolling motor housing 234 is provided at the second end 228 of the shaft 224*a*. The trolling motor assembly 108 may be provided such that the trolling motor 209 is configured to be attached on a watercraft 100 (see FIG. 1) so that the trolling motor housing 234 lies in a body of water 101 when the trolling motor 209 is attached to the watercraft 100 (see FIG. 1) and in a deployed state.

The trolling motor assembly 108 also includes an actuator 236. In some embodiments, the actuator 236 is configured to adjust a pointing direction and/or a depth of the trolling motor housing 234 relative to the watercraft 100 while the trolling motor 209 is attached to the watercraft 100. For example, the actuator 236 may accomplish this by rotating, shifting, or adjusting the angle of the shaft 224*a* and/or the position of the shaft 224*a* relative to the watercraft 100. In some embodiments, when activated, the actuator 236 may cause a movement routine to be executed, and the movement routine reduces a likelihood of ice buildup. The movement routine may at least temporarily adjust a position of the shaft 224*a*, and/or the movement routine may at least temporarily adjust an orientation of the shaft 224*a*. The actuator 236 may possess a shaft attachment feature 238, and this shaft attachment feature 238 may be configured to assist in attaching the actuator 236 to the shaft 224*a*. The actuator 236 may also possess a watercraft attachment feature 240, and this watercraft attachment feature 240 may be configured to assist in attaching the actuator 236 to the watercraft 100 (see FIG. 1). Where the actuator 236 is connected to the watercraft 100 via the watercraft attachment feature 240, movement routines executed at the actuator 236 may induce movement of the trolling motor 209 and the shaft 224*a* thereof relative to the watercraft 100.

In some embodiments, a sonar transducer assembly 102*d* may be attached to its own separate shaft 124*b* as illustrated in FIG. 1, and the actuator 236 may be used to adjust the pointing direction and/or the depth of the sonar transducer assembly 102*d*. The actuator 236 may cause a movement routine to be executed to reduce the likelihood of ice buildup at the sonar transducer assembly 102*d*. However, in some embodiments, the sonar transducer assembly 102*c* may be attached to the trolling motor housing 234 as illustrated in FIG. 2, and movement routines may reduce the likelihood of ice buildup for both the sonar transducer assembly 102*c* and the trolling motor assembly 108.

The movement routine may involve continuous movement of the trolling motor 209 in some embodiments, but the movement routine may involve periodic movement of the trolling motor 209 in other embodiments. In some embodiments, the movement routine may be executed when the trolling motor 209 is not being actively used to generate thrust, and this may be beneficial to avoid interfering with the normal functioning of the trolling motor 209 while the trolling motor 209 is actively being used.

In some embodiments, the trolling motor assembly 108 or a sonar transducer assembly may include a temperature sensor 112 that is configured to determine a temperature value, but the temperature sensor 112 may be provided at other locations on the watercraft 100 in other embodiments. In some embodiments, the temperature sensor 112 may take the form of a thermistor, but other types of temperature sensors may also be used. Memory 550*b* (see FIG. 5) may be provided in the trolling motor assembly 108 or a sonar transducer assembly, with the memory 550*b* having computer program code stored therein. Computer program code in memory may be configured to, when executed, cause a processor 548*b* (see FIG. 5) to receive the temperature value and adjust the movement routine based on the temperature value. The movement routine may be adjusted by increasing at least one of a frequency of movement, a duration of movement, or a magnitude of movement when the temperature value is below a threshold temperature value. Additionally or alternatively, memory 550*a* may be provided in a marine electronic device 560 (see FIG. 5), memory 550*c* may be provided in an actuator 236, or memory may be provided at another location. In addition, the computer program code in memory may be configured to cause another processor to perform these actions such as a processor 548*a* (see FIG. 5) in a marine electronic device 560, a processor 548*c* in an actuator 236, or a processor at another location.

In some embodiments, computer program code in memory may be configured to, when executed, cause a processor to receive a temperature value and to refrain from activating the actuator 236 and from causing the movement routine to be executed when the temperature value does not fall below a threshold temperature value. This may be beneficial to prevent the actuator 236 from being activated when little risk of ice buildup exists. This may allow energy to be conserved, and this may also assist in reducing the amount of wear and tear on the actuator 236, the trolling motor assembly 108, and/or the sonar transducer assembly.

In some embodiments, computer program code within memory may be configured to, when executed, cause a processor to perform a movement routine based on an indication of a depth of the trolling motor housing 234 (see FIG. 2) or an indication of a depth of a sonar transducer assembly. The depth of the trolling motor housing 234 (see FIG. 2) or the depth of the sonar transducer assembly may be received from a depth sensor 552 (see FIG. 5) in some embodiments. The computer program code may be configured to cause the processor to receive an indication of a depth of the trolling motor housing 234 (see FIG. 2) or the depth of the sonar transducer assembly, and adjust the movement routine based on the indication of the depth. The movement routine may be adjusted by reducing at least one of a frequency of movement, a duration of movement, or a magnitude of movement when the depth of the trolling motor housing 234 or the depth of the sonar transducer assembly is below a threshold depth value. By factoring the indication of the depth of the trolling motor housing 234 or the depth of the sonar transducer assembly into the determination of whether or not to perform a movement routine, the computer program code may prevent the movement routine from being executed in circumstances where doing so provides a limited benefit. For example, where the indication of the depth suggests that the depth is small, only a limited portion of the trolling motor assembly 108 or the sonar transducer assembly may be exposed to the body of water 101 (see FIG. 1), making it unnecessary to execute the movement routine.

The actuator 236 may aid in reducing the amount of ice buildup in components of the trolling motor assembly 108 as well as the sonar transducer assembly 102*c*. While the actuator 236 is configured to receive the shaft 224*a* of the trolling motor assembly 108, the actuator 236 may also be configured to receive the shaft 124*b* (see FIG. 1). In this way, the actuator 236 may similarly perform movement routines to reduce the amount of ice buildup at the sonar transducer assembly 102*d*.

Further details regarding the operation of the actuator 236 may be seen in FIGS. 3 and 4. FIG. 3 is a perspective view illustrating an example actuator 236 in isolation, and FIG. 4 is a perspective view illustrating an example actuator with a top cover of the actuator removed. The trolling motor assembly 108 depicted in the example embodiment of FIG. 2 may include the actuator 236 in some embodiments, and the actuator 236 may also be provided as part of a sonar transducer assembly in other embodiments. The actuator 236 may have a steering system 446 for changing the angular orientation of a shaft so as to change the pointing direction for the trolling motor 209, thereby steering the watercraft 100 (see FIG. 1) when the trolling motor 209 is operating with thrust. A change in the angular orientation of a shaft may also change the pointing direction of a sonar transducer assembly where a sonar transducer assembly is connected to the shaft. Notably, the actuator 236 may include a trim system 444 for changing the depth of the trolling motor housing 234 or the sonar transducer assembly (e.g., by causing the relevant shaft to raise or lower relative to the actuator 236 as indicated by the vertically extending arrows in FIGS. 2 and 3).

The actuator 236 may be moveably fixed about a shaft via a shaft attachment feature 238. In some embodiments, components of the actuator 236 may be configured to rotate the relevant shaft about the shaft axis A1, and to move the relevant shaft vertically along the shaft axis A1 and through the shaft attachment feature 238. The actuator 236 may also include a watercraft attachment feature 240 to enable connection or attachment to the watercraft 100. In some embodiments, the watercraft attachment feature 240 may allow for complete removal of the actuator 236, the trolling motor assembly 108, and/or a sonar transducer assembly from the watercraft 100. In other embodiments, the trolling motor assembly 108 and/or a sonar transducer assembly may be attached to the watercraft 100 about a hinge such that the trolling motor assembly 108 and/or a sonar transducer assembly may rotate about an attachment point and such that the trolling motor housing 234 and/or a sonar transducer assembly are removed from the water. In some embodiments, a watercraft attachment feature 240 may be configured to adjust the pointing direction of the trolling motor housing and/or a sonar transducer assembly relative to the watercraft 100 as indicated by the arrows to the right of the watercraft attachment feature 240 in FIG. 2. However, other features within the actuator 236 may be configured to adjust the pointing direction of the trolling motor housing or a sonar transducer assembly relative to the watercraft 100.

The actuator 236 may be provided with a top cover 239. The top cover 239 may be selectively removed to permit access to the internal components within the actuator 236. Furthermore, the top cover 239 may protect the internal components within the actuator 236 from exposure to water in some embodiments, with effective sealing provided within the top cover 239 and other portions of the actuator 236. The top cover 239 may include an opening 237 so that electrical cables, power supply lines, or other materials may enter into the actuator 236 or exit out of the actuator 236.

Further details regarding the internal components of the actuator 236 may be seen in FIG. 4, which provides a perspective view illustrating an example actuator 236 with a top cover 239 (see FIG. 3) of the actuator 236 removed. This permits certain internal components within the actuator 236 to be seen. The bottom cover 442 is illustrated in FIG. 4, and the top cover 239 (see FIG. 3) and the bottom cover 442 may together form an actuator housing. The shaft attachment feature 238 may define an internal recess, and the shaft attachment feature 238 may be configured to receive the relevant shaft (e.g. shaft 224*a* or the shaft 124*b* (see FIG. 1)) within this internal recess. The internal recess may define a shaft axis (A1), and the relevant shaft may be configured to extend along this shaft axis (A1) when received within the internal recess.

In the illustrated embodiment, the actuator 236 includes both a trim system 444 and a steering system 446 (although they could be separate mechanisms/systems in different embodiments). A motor may be provided within the actuator to operate the trim system 444 and/or the steering system 446, and a dedicated motor may be provided to operate each of these systems individually in some embodiments.

The trim system 444 is configured to adjust the vertical position of the relevant shaft relative to the actuator 236. The trim system 444 is designed to raise and lower the trolling motor 209 (see FIG. 2) so as to adjust the depth of the trolling motor housing 234 and/or a sonar transducer assembly in the body of water 101 (see FIG. 1). Trimming of the trolling motor housing 234 and/or a sonar transducer assembly may aid in preventing damage to the trolling motor housing 234 (such as due to objects in the underwater environment), preventing damage to a sonar transducer assembly, and/or aid in placement of various sensors mounted on the trolling motor housing 234 or a sonar transducer assembly at a desired depth (e.g., positioning a sonar system at a desired depth).

The steering system 446 may be configured to adjust the pointing direction of the trolling motor housing 234 (see FIG. 2) or a sonar transducer assembly (e.g., the sonar transducer elements) relative to the actuator 236. For example, viewing the actuator 236 in FIG. 3, the actuator 236 may cause the relevant shaft to rotate about the shaft axis (A1) as illustrated by the curved arrows at the top of FIG. 3. In addition to being used for movement routines for the prevention of ice buildup, the steering system 446 may be used to rotate the relevant shaft to a desired pointing direction so that the direction of the trolling motor housing may be altered and so that the direction of thrust generated by the trolling motor may be altered.

In some embodiments, the movement routine may solely involve vertical movement of the relevant shaft relative to the actuator 236 so that only the trim system 444 is used in executing the movement routine. In other embodiments, the movement routine may solely involve rotational movement of the relevant shaft relative to the actuator 236 so that only the steering system 446 is used in executing the movement routine. However, both the trim system 444 and the steering system 446 may be used as part of the movement routine in some embodiments so that the relevant shaft is rotated and shifted vertically relative to the actuator 236 during a movement routine. Further details regarding the operation of the actuator 236, the trim system 444, and the steering system 446 may be found in U.S. patent application Ser. No. 17/490,144, which is entitled "Combined Trim and Steering Trolling Motor System" and which is incorporated by reference herein for all purposes.

FIG. 5 is a block diagram illustrating example electrical components that may be used in an example system. A marine electronic device 560 may be provided. The marine electronic device 560 may have a processor 548*a*, a user interface 558, a display 554, a memory 550*a*, and a communication interface 556. The user interface 558 may receive inputs and commands from users, and the user interface 558 may receive such inputs and commands in various ways (through speech, touch, manual button inputs, etc.). The display 554 may present information such as nautical charts, sonar or radar information, and other navigational information. The display 554 may be a touch display in some embodiments so that user commands may be received at the display 554. The memory 550*a* may include computer program code that is configured to cause the processor 548*a* to perform various methods described herein, but this computer program code may be stored elsewhere as well.

A trolling motor assembly 508 is also provided. The trolling motor assembly 508 includes the trolling motor 509, but the trolling motor assembly 508 may also include a processor 548*b* and memory 550*b*. The memory 550*b* may include computer program code that is configured to cause the processor 548*b* to perform various methods described herein, but this computer program code may be stored elsewhere as well.

The actuator 536 is also provided. The actuator may include the trim system 544, which may possess a trim motor 544*a*. The trim system 544 may control the vertical position of the shaft 224*a* (see FIG. 2) relative to the actuator 536. Alternatively, the trim system 544 of the actuator 536 may be used to adjust the position of a shaft 124*b* (see FIG. 1) associated with the sonar transducer assembly 102*d* (see FIG. 1). The actuator 536 may also include the steering system 546, which may possess a steering motor 546*a*. The steering system 546 may control the rotational orientation of the shaft 224*a* relative to the actuator 536. Alternatively, the steering system 546 may control the rotational orientation of the shaft 124*b* associated with the sonar transducer assembly 102*d*. The actuator 536 may also include a processor 548*c* and memory 550*c*. The memory 550*c* may include computer program code that is configured to cause the processor 548*c* to perform various methods described herein, but this computer program code may be stored elsewhere as well.

While the processors and memory are shown at certain locations in FIG. 5, the processors and memory may be provided at other locations on a watercraft 100 (see FIG. 1) or they may be provided at locations remote from the watercraft 100 in some embodiments. Additionally, a temperature sensor 512, a depth sensor 552, and other devices 562 may be provided in some embodiments, and these components may be connected to the communication interface 556 in some embodiments.

Additionally, one or more sonar transducer assemblies may be provided. In the illustrated embodiment, a number (n) of sonar transducer assemblies are provided, with a first sonar transducer assembly 564*a*, a second sonar transducer assembly 564*b*, and a final sonar transducer assembly 564*n* being illustrated. The sonar transducer assemblies 564*a*, 564*b*, 564*n* illustrated in FIG. 5 may include one or more sonar transducer elements 567, such as may be arranged to operate alone or in one or more transducer arrays. In some embodiments, additional separate sonar transducer elements (arranged to operate alone, in an array, or otherwise) may be included. The sonar transducer assemblies 564*a*, 564*b*, 564*n* may also include a sonar signal processor or other processor (although not shown) configured to perform various sonar processing. In some embodiments, the processor (e.g., at least one processor 548*a* in the marine electronic device 560, a controller (or processor portion) in the sonar transducer assemblies 564, or a remote controller—or combinations thereof) may be configured to filter sonar return data and/or selectively control sonar transducer element(s) 567. For example, various processing devices (e.g., a multiplexer, a spectrum analyzer, A-to-D converter, etc.) may be utilized in controlling or filtering sonar return data and/or transmission of sonar signals from the sonar transducer element(s) 567.

The sonar transducer assemblies 564*a*, 564*b*, 564*n* may also include one or more other systems, such as various sensor(s) 566. For example, the sonar transducer assembly 564*a*, 564*b*, 564*n* may include an orientation sensor, such as gyroscope or other orientation sensor (e.g., accelerometer, MEMS, etc.) that can be configured to determine the relative orientation of the relevant sonar transducer assembly and/or the one or more sonar transducer element(s) 567—such as with respect to a forward direction of the watercraft. In some embodiments, additionally or alternatively, other types of sensor(s) are contemplated, such as, for example, a water temperature sensor, a current sensor, a light sensor, a wind sensor, a speed sensor, or the like.

FIG. 5 provides an example arrangement for components within an exemplary system. In other embodiments, the components may be rearranged. Furthermore, the connections between the components may be altered in other embodiments, and connections between components may be wired or wireless connections. Additionally, some components that are illustrated in FIG. 5 may be removed (e.g. processors 548*b* and 548*c* or memories 550*b* and 550*c*). In other embodiments, additional components may be added into the system.

An example methods 600A and 600B for prevention of ice buildup are illustrated in FIGS. 6A and 6B. Various components may be provided as part of the methods 600A and 600B. In method 600A of FIG. 6A, a trolling motor is provided at operation 610A. The trolling motor has a shaft with a first end and a second end. The trolling motor has a head housing provided at the first end of the shaft, and the trolling motor has a trolling motor housing provided at the second end of the shaft. The trolling motor is configured to be attached on a watercraft so that the trolling motor housing lies in a body of water when the trolling motor is attached to the watercraft and in a deployed state. In the method 600B of FIG. 6B, a sonar transducer assembly is provided at operation 610B instead of a trolling motor.

Methods 600A and 600B are generally identical for operations 620 through 650. At operation 620, an actuator is provided. At operation 630, user input, a temperature value, and/or an indication of depth is received. The temperature value may be received from a temperature sensor such as an underwater temperature sensor or an above-water temperature sensor that is configured to measure the air temperature. The indication of depth may be received from a depth sensor or some other sensor or source. The user input may be received from any components of the system.

At operation 640, a movement routine is performed, such as in response to receipt of the user input, temperature value, and/or depth value. The movement routine may be performed or adjusted based on the temperature values, the indication of the depth, or based on other factors. For example, the movement routine may be adjusted so that the movement routine will not be executed unless and until the temperature value is less than a certain threshold value; where this is the case, the actuator may be activated when the temperature value is less than a certain threshold value to cause a movement routine to be executed. In some embodiments, the movement routine may be adjusted based on an indication of the depth of the trolling motor housing or the sonar transducer assembly, and the actuator may be activated to cause a movement routine to be executed when the indication of the depth indicates that the depth exceeds a threshold value. In some embodiments, the movement routine may be adjusted so that it will only be executed when the trolling motor is not being actively used to generate thrust. Additionally, the movement routine may be adjusted by changing a frequency of movement, a magnitude of movement, or a duration of movement in some embodiments.

At operation 650, the actuator is activated, such as in conjunction with performance of a movement routine being executed. The actuator may be configured to perform the movement routine automatically, and the movement routine reduces the likelihood of ice buildup. As indicated herein, the movement routine adjusts the position and/or orientation of the relevant shaft relative to the watercraft while the trolling motor and/or the sonar transducer assembly is attached to the watercraft. In some embodiments, the movement routine may only temporarily adjust the position and/or orientation.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

That which is claimed:

1. A trolling motor assembly configured for prevention of ice buildup, the trolling motor assembly comprising:

a trolling motor comprising a shaft defining a first end and a second end, wherein the trolling motor further comprises a head housing at the first end and a trolling motor housing at the second end, and wherein the trolling motor is configured to be attached on a watercraft so that the trolling motor housing lies in a body of water when the trolling motor is attached to the watercraft and in a deployed state;

one or more actuators that are configured to adjust at least one of a pointing direction of the trolling motor housing or a depth of the trolling motor housing relative to the watercraft while the trolling motor is attached to the watercraft;

a processor; and a memory including computer program code configured to, when executed, cause the processor to:

activate the one or more actuators to cause a movement routine to be executed, wherein the movement routine is performed automatically, wherein the movement routine reduces a likelihood of ice buildup, and wherein the movement routine at least temporarily adjusts at least one of the depth or the pointing direction of the trolling motor housing relative to the watercraft.

2. The trolling motor assembly of claim 1, wherein the movement routine involves continuous movement of the trolling motor housing.

3. The trolling motor assembly of claim 1, wherein the movement routine involves periodic movement of the trolling motor housing.

4. The trolling motor assembly of claim 1, wherein the movement routine is executed when the trolling motor is not being actively used to generate thrust.

5. The trolling motor assembly of claim 1, further comprising:

a temperature sensor that is configured to determine a temperature value, wherein the computer program code is configured to, when executed, cause the processor to:

receive the temperature value; and adjust the movement routine based on the temperature value, wherein the movement routine is adjusted by increasing at least one of a frequency of movement, a duration of movement, or a magnitude of movement when the temperature value is below a threshold temperature value.

6. The trolling motor assembly of claim 5, wherein the temperature sensor is a thermistor.

7. The trolling motor assembly of claim 1, further comprising:

a temperature sensor that is configured to determine a temperature value, wherein the computer program code is configured to, when executed, cause the processor to:

receive the temperature value; and either, based on the temperature value, initiate the movement routine or refrain from activating the one or more actuators and from causing the movement routine to be executed.

8. The trolling motor assembly of claim 1, wherein the computer program code is configured to, when executed, cause the processor to:

receive an indication of the depth of the trolling motor housing; and adjust the movement routine based on the indication of the depth of the trolling motor housing, wherein the movement routine is adjusted by reducing at least one of a frequency of movement, a duration of movement, or a magnitude of movement when the depth of the trolling motor housing is below a threshold depth value.

9. The trolling motor assembly of claim 1, wherein the one or more actuators include a trim system, and wherein the movement routine causes the depth of the trolling motor housing to be changed using the trim system.

10. The trolling motor assembly of claim 9, wherein the movement routine reduces the likelihood of ice buildup at the trim system.

11. The trolling motor assembly of claim 1, wherein the one or more actuators include a steering system, and wherein the movement routine causes a rotational orientation change of the shaft of the trolling motor using the steering system.

12. The trolling motor assembly of claim 1, wherein the one or more actuators include a trim system and a steering system, and wherein the movement routine causes a vertical displacement change and a rotational orientation change of the shaft of the trolling motor using the trim system and the steering system.

13. A system configured for prevention of ice buildup, the system comprising:

a trolling motor comprising a shaft defining a first end and a second end, wherein the trolling motor further comprises a head housing at the first end and a trolling motor housing at the second end, and wherein the trolling motor is configured to be attached on a watercraft so that the trolling motor housing lies in a body of water when the trolling motor is attached to the watercraft and in a deployed state;

one or more actuators that are configured to adjust at least one of a pointing direction of the trolling motor housing or a depth of the trolling motor housing relative to the watercraft while the trolling motor is attached to the watercraft;

a processor; and a memory including computer program code configured to, when executed, cause the processor to:

activate the one or more actuators to cause a movement routine to be executed, wherein the movement routine is performed automatically, wherein the movement routine reduces a likelihood of ice buildup, and wherein the movement routine at least temporarily adjusts at least one of the depth or the pointing direction of the trolling motor housing relative to the watercraft.

14. The system of claim 13, further comprising:

a temperature sensor that is configured to determine a temperature value, wherein the computer program code is configured to, when executed, cause the processor to:

receive the temperature value; and adjust the movement routine based on the temperature value, wherein the movement routine is adjusted by increasing at least one of a frequency of movement, a duration of movement, or a magnitude of movement when the temperature value is below a threshold temperature value.

15. The system of claim 13, wherein the computer program code is configured to, when executed, cause the processor to:

receive an indication of the depth of the trolling motor housing; and adjust the movement routine based on the indication of the depth of the trolling motor housing, wherein the movement routine is adjusted by reducing at least one of a frequency of movement, a duration of movement, or a magnitude of movement when the depth of the trolling motor housing is below a threshold depth value.

16. A method for prevention of ice buildup, the method comprising:

providing a trolling motor comprising a shaft defining a first end and a second end, wherein the trolling motor further comprises a head housing at the first end and a trolling motor housing at the second end, and wherein the trolling motor is configured to be attached on a watercraft so that the trolling motor housing lies in a body of water when the trolling motor is attached to the watercraft and in a deployed state;

providing one or more actuators; and activating the one or more actuators to cause a movement routine to be executed, wherein the movement routine is performed automatically, wherein the movement routine reduces the likelihood of ice buildup, and wherein the movement routine at least temporarily adjusts at least one of a position or an orientation of the trolling motor housing relative to the watercraft while the trolling motor is attached to the watercraft.

17. The method of claim 16, wherein the one or more actuators are activated to cause a movement routine to be executed when the temperature value is less than a threshold value.

18. The method of claim 16, further comprising:

adjusting the movement routine based on an indication of the depth of the trolling motor housing, wherein the one or more actuators are activated to cause a movement routine to be executed when the indication of the depth indicates that the depth exceeds a threshold value.

19. The method of claim 18, wherein the movement routine is adjusted by changing a frequency of movement, a magnitude of movement, or a duration of movement.

20. The method of claim 16, wherein the movement routine is configured so as to only be executed when the trolling motor housing is not being actively used to generate thrust.

* * * * *